US006955011B1

(12) United States Patent
Meissner

(10) Patent No.: US 6,955,011 B1
(45) Date of Patent: Oct. 18, 2005

(54) BASEMENT WINDOW SHIELD WITH INTEGRATED VENT

(76) Inventor: Stephen D. Meissner, 2150 W. Hemlock Rd., Glendale, WI (US) 53209

( * ) Notice: Subject to any disclaimer, the term of this patent is extended or adjusted under 35 U.S.C. 154(b) by 71 days.

(21) Appl. No.: 10/248,914

(22) Filed: Feb. 28, 2003

(51) Int. Cl.[7] ..... E06B 5/02
(52) U.S. Cl. ..... 52/107; 52/3; 52/169.1; 52/273; 454/358
(58) Field of Search ..... 52/107, 3, 302.1, 52/169, 169.1, 273, 287; 454/212, 358

(56) References Cited

U.S. PATENT DOCUMENTS

| | | | | | |
|---|---|---|---|---|---|
| 300,654 | A | * | 6/1884 | Smith | 52/107 |
| 1,809,518 | A | | 6/1931 | Kubatzky | |
| 2,237,564 | A | * | 4/1941 | Keyes | 52/107 |
| 2,316,712 | A | * | 4/1943 | Prince et al. | 52/107 |
| 2,761,180 | A | * | 9/1956 | Krelwitz | 52/107 |
| 2,793,688 | A | * | 5/1957 | Robey | 160/104 |
| 2,898,638 | A | * | 8/1959 | Druckhamer | 52/107 |
| 3,046,613 | A | * | 7/1962 | Smith | 52/107 |
| 3,085,489 | A | * | 4/1963 | Ivy | 454/275 |
| 3,123,868 | A | * | 3/1964 | Gust | 52/107 |
| 3,562,972 | A | * | 2/1971 | D'Amato | 52/66 |
| 3,703,791 | A | * | 11/1972 | Slade | 52/107 |
| 3,999,334 | A | * | 12/1976 | Webb | 52/20 |
| D265,591 | S | * | 7/1982 | Kearnes | 52/107 |
| 4,903,455 | A | * | 2/1990 | Veazey | 52/800.11 |
| 5,339,579 | A | * | 8/1994 | Woodyer et al. | 52/107 |
| 5,433,663 | A | | 7/1995 | Henningsson et al. | |
| 6,165,065 | A | | 12/2000 | Pasij | |
| 6,581,338 | B2 | * | 6/2003 | Koenig et al. | 52/107 |
| 2003/0097802 | A1 | * | 5/2003 | Kim et al. | |
| 2003/0167705 | A1 | * | 9/2003 | Oakley | |

OTHER PUBLICATIONS www.windowwell.com.
Ultra Protect Window Well Cover Easy Installation Guide; 2002; pp. 1-5.
www.windowbubble.com.
Model 1-S Window Bubble with Redwood Extension—Round Style Bubble with Redwood Extension for Round Style Metal Window Wells Data Sheet; 2002; p. 1.
Model 2-S Window Bubble with Redwood Extension—Straight Style Bubble with Redwood Extension for Straight Style Metal Window Wells Data Sheet; 2002; p. 1.
Model 3-S Window Bubble—Low Profile Round Style Bubble for Metal Window Wells Data Sheet; 2002; p. 1.

(Continued)

*Primary Examiner*—Carl D. Friedman
*Assistant Examiner*—Nahid Amiri
(74) *Attorney, Agent, or Firm*—Ziolkowski Patent Solutions Group, SC

(57) ABSTRACT

A window well cover for a below-grade or basement window is disclosed. A transparent upper structure or portion is designed to cover a below-grade window on an outside of a building or other structure. The upper end of the transparent upper structure extends, or is angled, downwardly from a mounting flange terminating at a lower end. Furthermore, the transparent upper structure has two curved sides, which serve to connect the side ends. Mounting flanges extend outwardly from the two side ends. The window well cover includes a vent portion integrally formed therewith of an air pervious material to allow continuous air exchange through the window well cover. The vented portion may extend the length of, or the entire lower periphery of, the transparent upper structure. The window well cover, which is free of movable parts, allows for continuous airflow through the window well cover while restricting the entry of debris and insects.

32 Claims, 3 Drawing Sheets

OTHER PUBLICATIONS

Model 4-R Window Bubble—Rectangular Style Bubble for Round, Straight or Square Style Metal Window Wells Data Sheet; 2002; p. 1.

Model EC & EAC Window Bubble—Square Style Bubble for Metal Window Wells Data Sheet; 2002; p. 1.

* cited by examiner

BASEMENT WINDOW SHIELD WITH INTEGRATED VENT

BACKGROUND OF INVENTION

The present invention relates generally to a cover for window wells, and more specifically, to a cover for window wells that is vented to allow airflow through the window cover. Further, the venting is achieved without moving parts.

Typically, window well covers have been single-piece construction for the purpose of protecting a window well and accompanying window from dirt, animals, leaves and other debris. By enclosing the window well with this single-piece cover, typically constructed of plastic, and securing the cover to the building or ground, the window well is further protected from the elements.

However, such window well covers are typically not vented and as a result, in humid climates, condensation can form inside the cover and obstruct a view out of the window. Further, a build up of condensation within the window well cover can, over time, cause damage to the accompanying building. Similarly, such window covers do not allow ventilation into the building through the covered window. Additionally, it is impractical to remove the cover to alleviate a build up of moisture within the cover or to allow airflow through the window because such window covers are permanently attached.

Attempts to solve this problem include constructing window covers having a movable vent assembly, similar to a window or door, introduced into single-piece covers thereby forming a multi-piece cover. These ventable multi-piece covers only allow for airflow through the cover when the vent is physically open.

However, such assemblies add to the complexity of the design by including multiple interconnected pieces, much like a door and hinge assembly. Furthermore, in such window covers having movable venting means, it is necessary to physically open and close the vent when desiring airflow or protection from the elements. The inclusion of multiple pieces not only adds to production costs but when exposed to the harsh conditions of the elements, these additional parts are susceptible to breakdown and often require upkeep and management to maintain consistent operation.

Therefore, it would be advantageous to design a window well cover that provides the protection and simplicity of single-piece covers but allows airflow absent the upkeep and management typically associated with covers having multiple moving parts. Furthermore, it would be advantageous to design such a window well cover that does not require physical management of the vent assembly to allow airflow.

BRIEF DESCRIPTION OF INVENTION

The present invention discloses a window well cover that solves the aforementioned problems by providing a continuous vent without movable parts.

The invention includes a window well cover that protects window wells from collecting debris and from the elements as well as protecting people and animals from accidental entry while allowing continuous airflow. Additionally, the window well cover provides the aforementioned protection and airflow while alleviating the need for movable parts and their associated maintenance.

Therefore, in accordance with one aspect of the invention, a window well cover is disclosed that includes both a dome portion of a weather impervious material having a periphery to substantially cover a window well and a vent portion of an air pervious material to allow continuous air exchange through the window well cover. The vent portion is directly connected to the dome portion and extends along at least a portion of the periphery of the dome portion.

In accordance with another aspect of the invention, a window well cover that is free of movable parts is disclosed. The window well cover includes a transparent upper structure designated to substantially cover a below-grade window or an outside of a building. The window well cover further includes a vent constructed integrally within the transparent upper structure. The vent is capable of allowing air flow while restricting debris from passing therethrough.

In accordance with another aspect of the invention, a window well cover is disclosed that includes a planar top portion constructed to cover a below-grade window. The window well cover further includes a vent portion directly connected to the planar top portion and formed of an air pervious material to allow continuous air exchange through the window well cover.

Various other features, objects and advantages of the present invention will be made apparent from the following detailed description and the drawings.

BRIEF DESCRIPTION OF DRAWINGS

The drawings illustrate multiple embodiments presently contemplated for carrying out the invention.

In the drawings.

DETAILED DESCRIPTION

Figure 1:
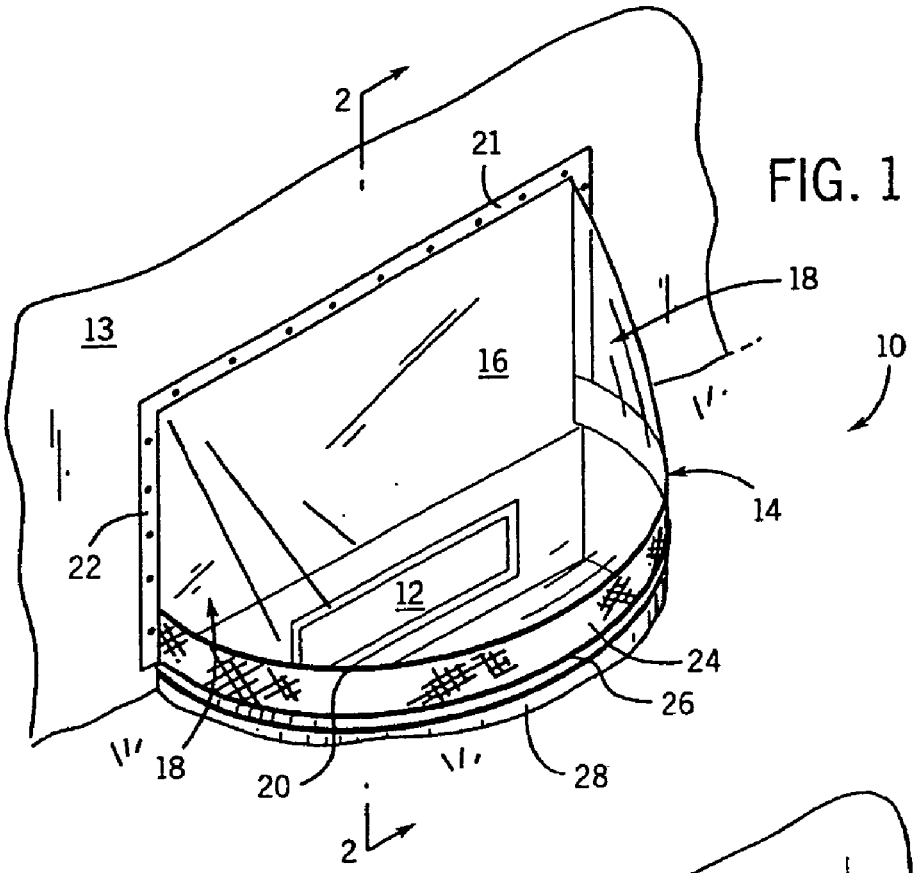
FIG. 1 is a perspective view of a window well cover in accordance with one embodiment of the present invention attached to a structure having a below grade window.

Referring to FIG. 1, a window well cover 10 is shown in accordance with one embodiment of the present invention. The window well cover 10 is designed to cover a below-grade window 12 of a building or other structure 13. The window well cover 10 includes a transparent upper structure 14 having a dome shape, that forms the upper end of the window well cover 10 and is comprised of a weather-impervious material. Preferably, the dome portion 14 is formed of plastic, glass or another weather-impervious material that is preferably transparent. Using a transparent material allows a line of sight as viewed from inside the covered window out beyond the window well cover 10 through the dome portion 14 and allows light entry through the dome 14, below-grade window 12 and into the building or structure 13. However, it is contemplated that the dome portion 14 could be constructed of an opaque material in order to restrict light entry through the window well cover 10 if desired. Additionally, dome portion 14 could be constructed of a material that allows a line of sight from inside the covered window to outside the window well cover but substantially reduce any lines of sight from outside the window well cover to inside the window well cover. Use of such a material would afford a certain level of privacy and seclusion, yet allow entry of light that may be desirable to some consumers.

The dome portion 14 has an upper end 16 that extends to converge with two side ends 18 to form a curved lower end 20 forming a radius between the two side ends 18. An upper mounting flange 21 extends from the upper end 16 and similar mounting flanges 22 extend from the two side ends 18. Mounting flanges 21, 22, separately or together, can be used to secure the window well cover 10 to the building 13 to enclose the below-grade window 12. It is contemplated that nails, screws, staples or similar fastening means could be used to puncture the mounting flanges 21, 22 and extend into the building, thus securing the window well cover 10 against the building or structure 13. Furthermore, it is also alternatively contemplated that non-intrusive fastening means, such as caulk or other adhesives, may also be used to secure the window well cover 10 against the structure 13. Also, it is contemplated that mounting flange 21 may be used to secure the window well cover 10 by positioning the mounting flange 21 under a building exterior, such as under one section of lap siding to secure the window well cover 10 to structure 13 in such a manner to limit movement of the cover relative to the below-grade window 12. In this arrangement the side mounting flanges 22 could be eliminated and the lower portion of the window well cover could be fastened to the window well wall 28.

The window well cover 10 further includes a vent portion 24 formed of an air pervious material to allow continuous air exchange through the window well cover 10. As shown, the vent portion 24 may extend the entire length of a lower periphery of the dome portion 14. However, it is also contemplated that the vented portion 24 may extend along only a portion of the lower periphery of the dome portion 14. Also, extending from the vent portion 24 is a lower support 26, which extends along the periphery of the vented portion. This lower support 26 also extends vertically from the vent portion 24 to meet window well wall 28 in order to provide support for the vent portion 24 and dome portion 14. As such, a secure base is created to support the assembly.

Figure 2:
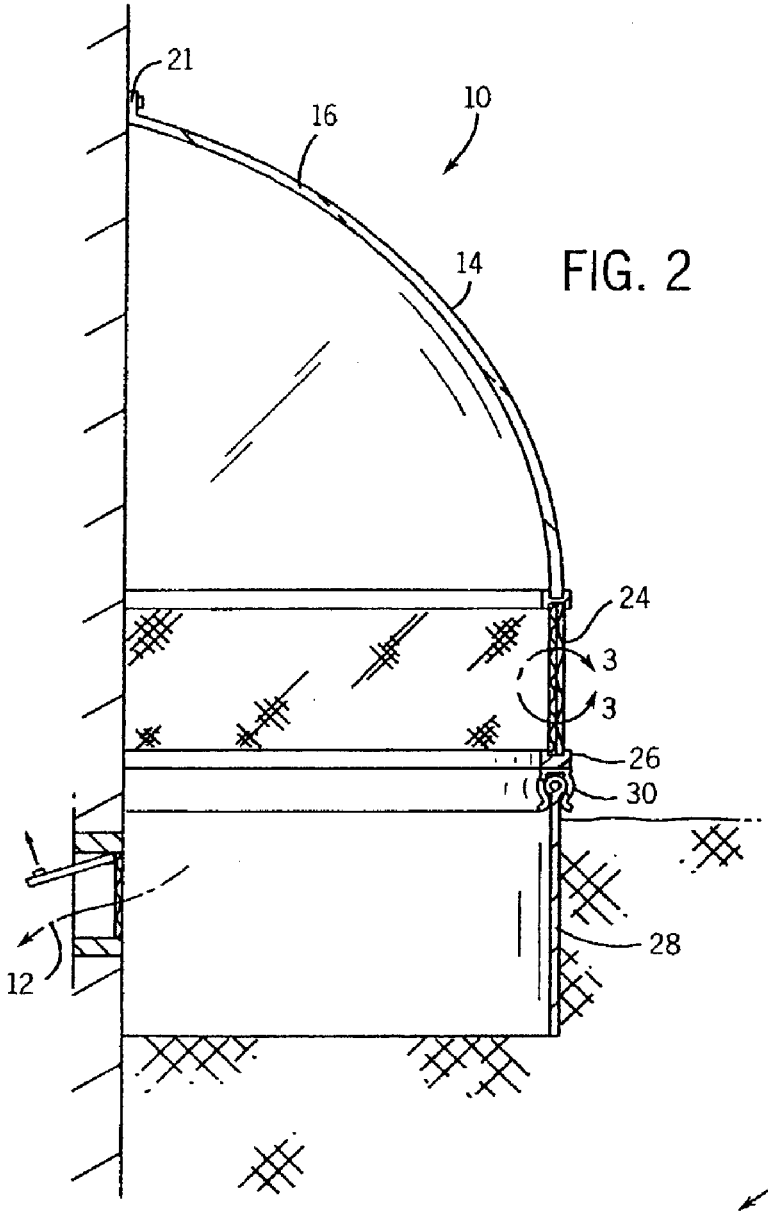
FIG. 2 is a cross-sectional view of the window well cover and attached structure taken along line 2—2 of FIG. 1.

Referring now to FIG. 2, a cross-sectional view of the window well cover 10 and below-grade window 12 taken along line 2—2 of FIG. 1 is shown. The lower support 26 is shown as preferably including a mounting clip 30. The mounting clip 30 extends downwardly from the lower support 26 and engages or attaches to the window well wall 28 to secure the window well cover 10 to the window well wall 28. It is further contemplated that the mounting clip 30 can be used in lieu of or in conjunction with the mounting flanges 21, 22. Additionally, it is contemplated that a plurality of support rods 31, shown in phantom, may be included around a periphery of the dome portion 14 to provide additional support to the dome portion 14 beyond the support provided by the vent portion 24. As indicated in FIG. 2, the vent portion 24 allows air flow not only with the window well cover 10 to prevent the accumulation of condensation, but also allows for ventilation into the building though window 12.

Figure 3:
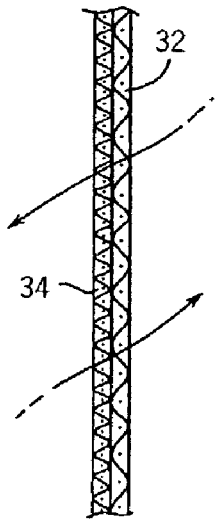
FIG. 3 is a cross-sectional of a venting portion of the window well cover of FIG. 1 view taken along line 3—3 of FIG. 2.

Referring to FIG. 3, a cross-sectional view of the vent portion 24 taken along line 3—3 of FIG. 2 is shown. The vent portion 24 preferably includes two layers of venting material an outer layer 32 and an inner layer 34. The outer layer 32 is more porous than the inner layer 34. In this embodiment, the outer layer 32 is preferably formed of a rigid material to support the dome portion while allowing airflow therethrough. The inner layer 34 is constructed of a less course material to restrict the entry of insects and debris yet also allow airflow therethrough. It is further contemplated that the outer layer 32 and the inner layer 34 may be of different venting material. Suitable materials such as metal, plastic, porous cloth, etc. are within the wide range of material suitable for the venting material.

In an alternative embodiment, a single layer of venting material may be used. This single layer, composed of a material similar to the aforementioned inner layer, serves to restrict the entry of debris and insects into the window well cover 10 but also allows airflow. To provide support, a plurality of supports are provided along the periphery of the vent. These supports are constructed from a rigid material extend vertically down from the dome portion 14 to the lower support 26.

Figure 4:
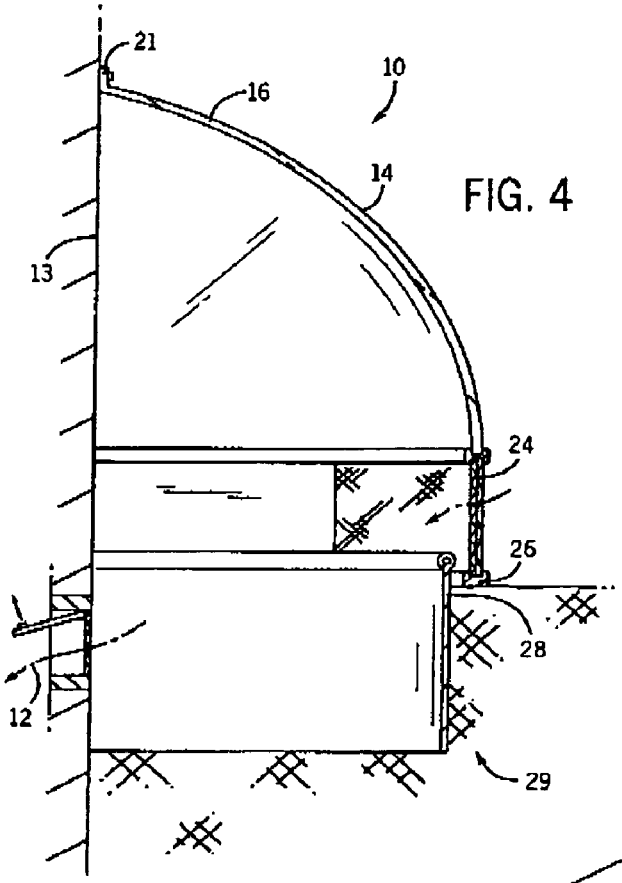
FIG. 4 is a cross-sectional view similar to FIG. 2 showing another embodiment of the present invention.

Referring to FIG. 4, a cross-sectional view of the window well cover 10 and below-grade window 12 in accordance with another embodiment of the present invention is shown. As indicated, the dome portion 14 and vent portion 24 are designed such that window well cover 10 extends beyond the window well wall 28 to surround an exposed portion 35 of the window well wall that extends vertically above a ground area 29. Lower support 26 is designed to provide support by engaging ground area 29.

Figure 5:
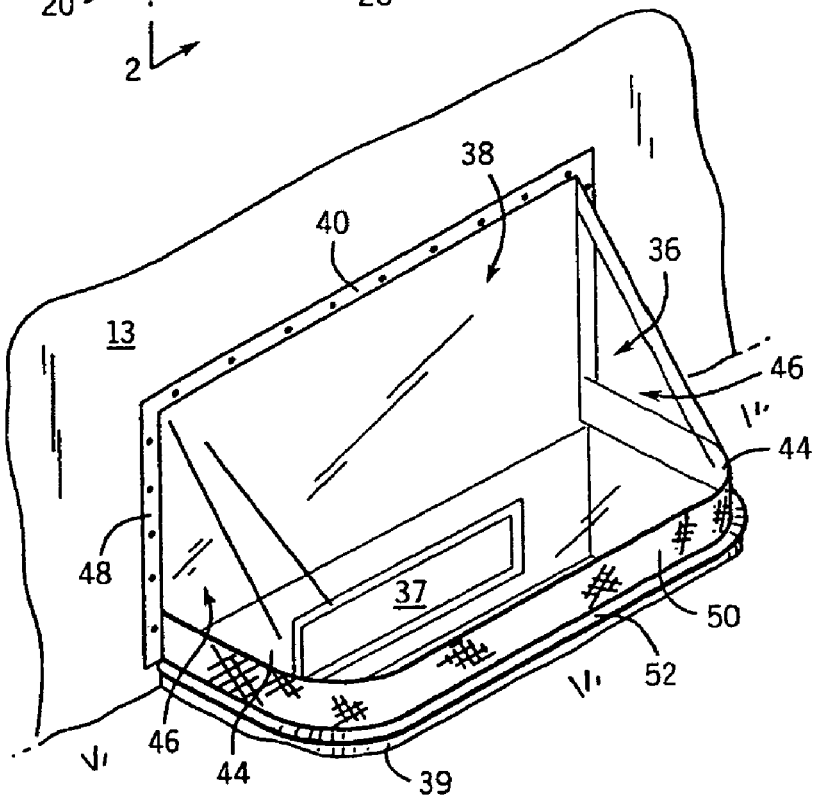
FIG. 5 is a perspective view similar to FIG. 1 showing another embodiment of the present invention.

Referring to FIG. 5, a window well cover 35 in accordance with another embodiment of the present invention is illustrated. A transparent upper structure or portion 36 is designed to cover a below-grade window 37 on an outside of a building 13 or other structure. The upper end 38 of the transparent upper structure 36 extends, or is angled, downwardly from the mounting flange 40 terminating at a lower end 42, which is substantially parallel to the mounting flange 40. Furthermore, the transparent upper structure 36 has two curved sides 44, which serve to connect the side ends 46. Mounting flanges 48 extend outwardly from the two side ends 46. Mounting flanges 40, 48, separately or together, can be used to secure the window well cover 35 to the building 13 or previously described to enclose the below-grade window 37. The window well cover 35 includes a vent portion 50 formed of an air pervious material to allow continuous air exchange through the window well cover 35 while remaining free of moving parts. As shown, the vented portion 50 may extend the length of, or the lower periphery of, the transparent upper structure 38. However, it is also contemplated that the vented portion 50 may extend only a portion of the lower periphery of the transparent upper structure 38. Also, extending from the vent portion 50 is a lower support 52, which extends along the periphery of the vented portion. This lower support 52 also extends vertically from the vent portion 50 to meet a window well wall 39 thereby creating a secure base to support the vented portion 50, transparent upper structure 36 and flanges 40, 48.

The embodiments shown in FIGS. 1 and 5 are indicative of the various shapes of window wells and therefore, the alternative construction shapes of the covers. Other shapes are also contemplated and are well within the scope of the claims of the present invention.

Figure 6:
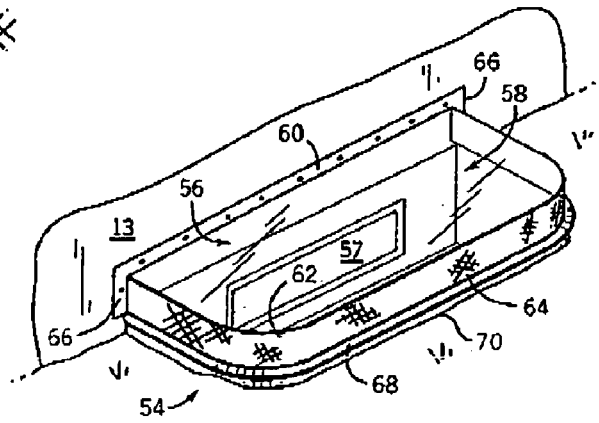
FIG. 6 is a perspective view similar to FIG. 1 showing another embodiment of the present invention.

Referring to FIG. 6, a perspective view of a window well cover 54 in accordance with yet another embodiment of the present invention is shown. The window cover 54 includes a planar top portion 58 that is constructed to cover a below grade window 57. The planar top portion 58 is formed by an inner end 56 extending horizontally to meet outer end 62. A mounting flange 60 extends upward from the inner end 56 such that the mounting flange 60 is substantially parallel to the planar top portion 58. Further, extending from outer end 62 is a vent portion 64 integrally formed with transparent portion 58. The vent portion 64 is formed of an air pervious material to allow continuous air exchange through the window well cover 54 while restricting debris. As shown, the vented portion 64 extends downwardly from the transparent portion 58 such that it is positioned substantially perpendicular to the transparent portion 58. Furthermore, the vented portion 64 may extend along the length of the transparent portion 58. Mounting flanges 66 may also extend from the vent portion 64. Also extending from the vent portion 64 is a lower support 68, which extends horizontally along at least a portion of the periphery of the vented portion 64. This lower support 68 also extends vertically from the vent portion 64 to meet a window well wall 70 and support the transparent portion 58, vented portion 64 and mounting flanges 60, 66.

Therefore, in accordance with one embodiment of the invention, a window well cover is disclosed. The includes both a dome portion of a weather impervious material having a periphery to substantially cover a window well and a vent portion of an air pervious material to allow continuous air exchange through the window well cover. The vent portion is directly connected to the dome portion and extends along at least a portion of the periphery of the dome portion.

In accordance with another embodiment of the invention, a window well cover that is free of movable parts is disclosed that includes a transparent upper structure designated to substantially cover a below-grade window or an outside of a building. The window well cover further includes a vent constructed integrally within the transparent upper structure. The vent is capable of allowing air flow while restricting debris from passing therethrough.

In accordance with another embodiment of the invention, a window well cover is disclosed that includes a planar top portion constructed to cover a below-grade window. The window well cover further includes a vent portion directly connected to the planar top portion and formed of an air pervious material to allow continuous air exchange through the window well cover.

The present invention has been described in terms of the preferred embodiment, and it is recognized that equivalents, alternatives, and modifications, aside from those expressly stated, are possible and within the scope of the appending claims.

What is claimed is:

1. A window well cover comprising:

a dome portion forming an upper end of the window well cover, the dome portion comprised of a weather impervious material and having a periphery to substantially cover a window well, wherein the dome portion has an upper end and two side ends, the upper end having a rigidly attached mounting flange extending therefrom; and a vent portion directly connected to the dome portion and extending along at least a portion of the periphery of the dome portion and formed of an air pervious material to allow continuous air exchange through the window well cover.

2. The window well cover of claim 1 wherein the dome portion is designed to cover a below-grade window of a structure and has a mounting portion for attachment to the structure and wherein the vent portion extends an entire length of the dome.

3. The window well cover of claim 1 wherein the dome portion is angled downwardly from the mounting flange.

4. The window well cover of claim 3 wherein the upper end converges with the two side ends to form a curved lower end forming a radius between the two side ends.

5. The window well cover of claim 4 wherein the two side ends have a mounting flange extending therefrom.

6. The window well cover of claim 3 wherein the upper end extends downwardly and terminates at a lower end of the dome portion that is substantially parallel to the mounting flange.

7. The window well cover of claim 6 wherein the substantially parallel lower end of the dome portion has two curved sides, each that connect to the side ends of the dome portion.

8. The window well cover of claim 1 wherein the vent portion extends at least a portion of a lower periphery of the dome portion.

9. The window well cover of claim 1 wherein the vent portion extends along an entire length of a lower periphery of the dome portion.

10. The window well cover of claim 1 further comprising a lower support extending about a periphery of the vent portion.

11. The window well cover of claim 10 wherein the lower support extends an entire length of a lower periphery of the window well cover.

12. The window well cover of claim 10 further comprising a mounting clip extending downwardly from the lower support attachable to a window well wall.

13. The window well cover of claim 10 wherein the lower support extends downwardly from the vent portion and overlaps a window well wall.

14. The window well cover of claim 1 wherein the window well cover is free of movable parts.

15. A window well cover with integral vent comprising:

a transparent upper structure to cover a below-grade window on an outside of a building;

a vent constructed integrally within the transparent upper structure and having airflow capability while restricting entry of debris; wherein the vent is comprised of two parallel layers of venting material;

wherein the window well cover is free of movable parts; and wherein the vent is positioned at a base of the transparent upper structure.

16. The window well cover of claim 1 wherein the dome portion is at least partially opaque.

17. The window well cover of claim 1 wherein the vent is comprised of two layers of venting material.

18. The window well cover of claim 17 wherein the two layers of venting material are dissimilar.

19. The window well cover of claim 18 wherein the two layers include an outer layer of venting material that is more porous than an inner layer of venting material.

20. The window well cover of claim 17 wherein an outer layer of venting material is rigid to support the transparent upper structure and is designed to engage a lower support and to allow airflow therethrough.

21. The window well cover of claim 17 wherein an inner layer of venting material is designed to allow airflow and restrict entry of insects therethrough.

22. The window well cover of claim 15 wherein the vent includes one layer of venting material and a plurality of support rods around a periphery of the transparent upper structure.

23. A window well cover comprising;

a planar top portion constructed to cover a below-grade window on an outside of a building;

a vent portion directly connected to the planar top portion and formed of an air pervious material to allow continuous air exchange through the window well cover;

wherein a rigidly attached mounting flange, attachable to the outside of the building, extending from an inner end of the planar top portion is substantially perpendicular to the planar top portion; and wherein the vent portion is substantially parallel to the mounting flange.

24. The window well cover of claim 23 wherein the inner end of the top portion extends horizontally and terminates at an outer end that is substantially parallel to the mounting flange.

25. The window well cover of claim 23 wherein the vent portion extends downwardly from an outer end of the planar top portion and is positioned substantially perpendicular to the planar top portion.

26. The window well cover of claim 23 wherein the vent portion has at least one mounting flange extending therefrom.

27. The window well cover of claim 23 wherein the vent portion extends about a periphery of the planar top portion.

28. The window well cover of claim 23 further comprising a lower support extending along at least a portion of a periphery of the vent portion.

29. The window well cover of claim 23 wherein a lower support extends along an entire length of a periphery of the window well cover.

30. The window well cover of claim 28 further comprising a mounting clip extending downwardly from the lower support attachable to a window well wall.

31. The window well cover of claim 23 wherein the window well cover is free of movable parts.

32. A window well cover comprising:

a unitary planar top portion and mounting flange constructed as a one-piece unit and arranged to allow covering of a below-grade window; and a vent portion connected to the unitary planar top portion and mounting flange, the vent portion formed of an air pervious material to allow continuous air exchange through the window well cover wherein the vent includes one layer of venting material and a plurality of support rods around a periphery of the transparent upper structure.

* * * * *